US006382066B1

(12) United States Patent
Maier et al.

(10) Patent No.: US 6,382,066 B1
(45) Date of Patent: May 7, 2002

(54) METHOD AND DEVICE FOR SLITTING A MATERIAL WEB

(75) Inventors: Robert Maier, Reidling (DE); Franz Reisinger, Wald (AU)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/358,663

(22) Filed: Jul. 21, 1999

(30) Foreign Application Priority Data

Jul. 22, 1998 (DE) ..... 198 32 871

(51) Int. Cl.[7] ..... B26D 2/00

(52) U.S. Cl. ..... 83/698.61; 83/504; 83/499; 83/614

(58) Field of Search ..... 83/62, 60, 72, 83/74, 498, 499, 504, 505, 507, 508.2, 508.3, 698.51, 698.61, 614

(56) References Cited

U.S. PATENT DOCUMENTS

| | | | | | |
|---|---|---|---|---|---|
| 4,072,887 | A | * | 2/1978 | Buschmann et al. | 83/11 |
| 4,188,846 | A | * | 2/1980 | Jones et al. | 83/499 |
| 4,224,847 | A | * | 9/1980 | Tokuno | 83/71 |
| 4,548,105 | A | * | 10/1985 | Koutonen | 83/13 |
| 4,548,109 | A | * | 10/1985 | Tokuno et al. | 83/71 |
| 4,592,259 | A | * | 6/1986 | Gomer et al. | 83/13 |
| 4,607,552 | A | * | 8/1986 | Siler | 83/71 |
| 4,836,458 | A | * | 6/1989 | Cavagna | 83/499 |
| 4,899,630 | A | * | 2/1990 | Shioya et al. | 83/425.4 |
| 5,072,641 | A | * | 12/1991 | Urban et al. | 83/499 |
| 5,433,649 | A | * | 7/1995 | Nishida | 83/62 |
| 5,735,184 | A | * | 4/1998 | Miller et al. | 83/504 |

FOREIGN PATENT DOCUMENTS

| | | |
|---|---|---|
| DE | 3407258 | 9/1984 |
| DE | 3417042 | 6/1987 |
| DE | 94100691 | 10/1994 |

* cited by examiner

*Primary Examiner*—M. Rachuba
*Assistant Examiner*—Kim Ngoc Tran
(74) *Attorney, Agent, or Firm*—Greenblum & Bernstein, P.L.C.

(57) ABSTRACT

Method and a device for slitting a material web traveling in the run direction in which at least one knife unit with a cutting edge, and arranged on a carrier that is movable transversely to the run direction in a machine frame, is positioned. A measurement device measures the position. The position measurement is improved in that the measurement device has two measurement transducers. A first measurement transducer is arranged on the carrier and measures the distance from the cutting edge to a reference point that is fixed with respect to the carrier. A second measurement transducer measures the distance between a reference point that is fixed with respect to the carrier and a zero point that is fixed in the machine frame. The absolute position of the cutting edge is established by combining the two distances.

19 Claims, 1 Drawing Sheet

METHOD AND DEVICE FOR SLITTING A MATERIAL WEB

BACKGROUND OF THE INVENTION

This application claims the benefit of German Patent Application No. 198 32 871.0 filed on Jul. 22, 1998, the content of which is expressly incorporated by reference herein.

1. Field of the Invention

This invention relates to methods and devices for slitting a material web, and more specifically to a method and device for slitting a material web traveling in the run direction in which the absolute position of a cutting edge of at least one knife unit, on a carrier in a machine frame, is established by combining measurements obtained by two measurement transducers.

2. Discussion of Background Information

Paper webs are frequently produced in widths that are too large for the subsequent user. Modem papermaking machines produce paper webs in widths of up to approximately 10 m. Users, such as printing businesses, currently use paper webs up to a maximum of approximately 3.8 m. In most cases, the desired width is even smaller, namely in the range of approximately 0.8 to 2 m.

Therefore, it is necessary to divide the paper web into several web sections before reeling it onto winding rolls. This slitting is done at each slitting line with a knife unit that usually operates in a "scissor-like" manner. The knife unit may include a circular top knife on one side of the paper web and a likewise circular bottom knife on the other side of the paper web. At least one of these knives is driven. The plane of contact between the top knife and the bottom knife forms the cutting edge. The cutting edge usually coincides with one end face of the bottom knife.

The web section width desired by the customer is usually specified rather precisely. The permissible variations in this regard lie in the region of approximately ±0.25 mm. In order to achieve this precision, it must be possible to position the cutting edges of the knife unit with corresponding precision. Once the knife unit has been brought into the desired position, it is normally necessary to measure once again to determine whether the cutting edge has also reached the desired position. For example, a steel tape measure that is stretched parallel to the direction of motion of the carrier from a precisely defined reference position on the machine frame with specified tension may be used for this purpose. The positions of the individual cutting edges may then be read from this tape measure. If these positions are then entered into a stored-program control unit, other positions may subsequently be attained, for example, by changing the cutting plane. This process is also referred to as manual calibration. This type of manual calibration is relatively laborious and time-consuming.

DE 34 07 258 A1 discloses moving a measurement transducer across the working width after the positioning of the carrier and thus the cutting edges. The measurement transducer measures the positions of the cutting edges relative to a zero point fixed with respect to the machine. However, the individual cutting edge positions can be measured in this manner only one at a time. A continuous measurement is not possible. For this reason, the determination of all positions takes a relatively long time, and indeed takes more time the longer the measurement distance is. The determination of the cutting edge positions is relative. Further, the values of the positions are not available immediately after the device starts up.

DE 34 17 042 C2 discloses a similar process in which, on the one hand, the position of the carrier in the machine frame is measured, but, on the other hand, the position of the knife edge on the respective carrier is also measured. To accomplish this, the individual carriers are moved sequentially past sensors that are fixed to the machine frame, where the time between the passage of a marking on the carrier and the passage of the cutting edge permits a determination about the distance from the cutting edge to this marking. This procedure is advantageous in that information about the position of the carrier in the machine frame is available on an ongoing basis during operation. However, the absolute position of the cutting edge is still subject to error. This results from the fact that, on the one hand, the position of the cutting edge can only be measured in a relative manner, and, on the other hand, errors arising during operation, for example, as a result of wear, are not detected.

The knives of a knife unit must normally be resharpened from time to time. Consequently, recalibration is required after each resharpening. In addition, wear phenomena occur during operation which are the same order of magnitude as the tolerance range.

SUMMARY OF THE INVENTION

Accordingly, the present invention is directed to a method and device for slitting a material web that substantially obviates one or more of the problems arising from the limitations and disadvantages of the related art.

It is an object of the present invention to provide a method and device for slitting a material web that improves the determination of the position of the cutting edge of a knife unit.

It a further object of the present invention to provide a method and device for slitting a material web that continuously monitors the position of the cutting edge of a knife unit.

Another object of the present invention is to provide a method and device for slitting a material web that outputs an error message if the monitored position of the cutting edge of a knife unit falls below a predetermined minimum, or is above a predetermined maximum.

Accordingly, one aspect of the present invention is directed to a method for slitting a material web traveling in the run direction. A knife unit on a carrier in a machine frame is moved transversely to the run direction. The position of a cutting edge of the knife unit on the carrier is measured. The position of the carrier in the machine frame is measured. An absolute position of the cutting edge in the machine frame is established by combining the measured position of the cutting edge on the carrier and the position of the carrier in the machine frame.

According to another aspect of the present invention, the position of the cutting edge on the carrier is measured by measuring a distance between the cutting edge and a first reference point that is fixed with respect to the carrier.

According to yet another aspect of the present invention, the invention includes monitoring to determine whether the distance between the cutting edge and the first reference point exceeds a predetermined minimum dimension, and outputting an error message if the distance between the cutting edge and the first reference point exceeds the predetermined minimum dimension.

In a further aspect of the present invention, the invention includes monitoring to determine whether the distance between the cutting edge and the first reference point falls below a predetermined maximum dimension, and outputting an error message if the distance between the cutting edge and the first reference point falls below the predetermined maximum dimension.

According to another aspect of the present invention, both the position of the cutting edge on the carrier and the position of the carrier in the machine frame are continuously measured.

According to yet another aspect of the present invention, the invention includes resting a mating knife against the cutting edge. The mating knife is spring biased and located on a bottom side of the material web. The cutting edge and the mating knife operate in a scissor-like manner to create a cutting line in the material web defined by the position of the cutting edge.

According to a further aspect of the present invention, the position of the cutting edge on the carrier and/or the position of the carrier in the machine frame are measured optically.

According to another aspect of the present invention, the position of the cutting edge on the carrier and/or the position of the carrier in the machine frame are measured acoustically.

According to yet another aspect of the present invention, the position of the cutting edge on the carrier and/or the position of the carrier in the machine frame are measured magnetically.

According to a further aspect of the present invention, the position of the cutting edge on the carrier and/or the position of the carrier in the machine frame are measured electromagnetically.

According to another aspect of the present invention, the position of the cutting edge on the carrier and/or the position of the carrier in the machine frame are measured capacitively.

A further aspect of the present invention is directed to a device for slitting a material web traveling in the run direction including at least one knife unit having a cutting edge. The at least one knife unit is on a carrier movable transversely to the run direction in a machine frame. A measurement device exists to measure the position of the cutting edge. The measurement device includes a first measurement transducer and a second measurement transducer. The first measurement transducer is arranged on the carrier and measures the distance of the cutting edge to a first reference point that is fixed with respect to the carrier. The second measurement transducer measures the distance to a second reference point that is fixed with respect to the carrier from a zero point. The zero point is fixed in a machine frame.

According to another aspect of the present invention, the second measurement transducer includes a stationary active part and a movable passive part.

According to yet another aspect of the present invention, the active part is a linear measurement scale.

In a further aspect of the present invention, the first reference point and the second reference point coincide.

According to another aspect of the present invention, a comparator is connected to the first measurement transducer. The comparator outputs an error message if the distance of the cutting edge to the first reference point exceeds a predetermined value.

According to yet another aspect of the present invention, a comparator is connected to the first measurement transducer. The comparator outputs an error message if the distance of the cutting edge to the first reference point drops below a predetermined value.

A further aspect of the present invention is directed to a device for slitting a material web traveling in the run direction that includes: a carrier in a machine frame where the carrier is movable transversely to the run direction; at least one knife unit having a cutting edge where the at least one knife unit is attached to the carrier; a first measurement transducer arranged on the carrier and that measures the distance of the cutting edge to a first reference point that is fixed with respect to the carrier; and a second measurement transducer that measures the distance to a second reference point that is fixed with respect to the carrier from a zero point where the zero point is fixed in a machine frame, and wherein an absolute position of the cutting edge in the machine frame is established by combining the measured distance of the cutting edge to the first reference point and the measured distance of the second reference point to the zero point in the machine frame.

According to another aspect of the present invention, the carrier is supported on rollers that are movable along rails.

According to yet another aspect of the present invention, the at least one knife unit includes a circular knife driven by a motor.

In a further aspect of the present invention, the invention includes a mating knife located on a bottom side of the material web where the mating knife is under a spring force and rests against an end face of the circular knife. The circular knife and the mating knife operate in a scissor-like manner to create a cutting line in the material web defined by the position of the cutting edge.

According to another aspect of the present invention, the first measurement transducer and/or the second measurement transducer operate in a non-contacting manner.

According to yet another aspect of the present invention, the non-contacting manner is optical.

According to a further aspect of the present invention, the non-contacting manner is acoustical.

According to another aspect of the present invention, the non-contacting manner is magnetic.

According to yet another aspect of the present invention, the non-contacting manner is electromagnetic.

According to a further aspect of the present invention, the non-contacting manner is capacitive.

According to yet another aspect of the present invention, the first reference point and the second reference point coincide.

In a further aspect of the present invention, a comparator is connected to the first measurement transducer where the comparator outputs an error message if the distance of the cutting edge to the first reference point exceeds a predetermined value.

According to another aspect of the present invention, a comparator is connected to the first measurement transducer where the comparator outputs an error message if the distance of the cutting edge to the first reference point drops below a predetermined value.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
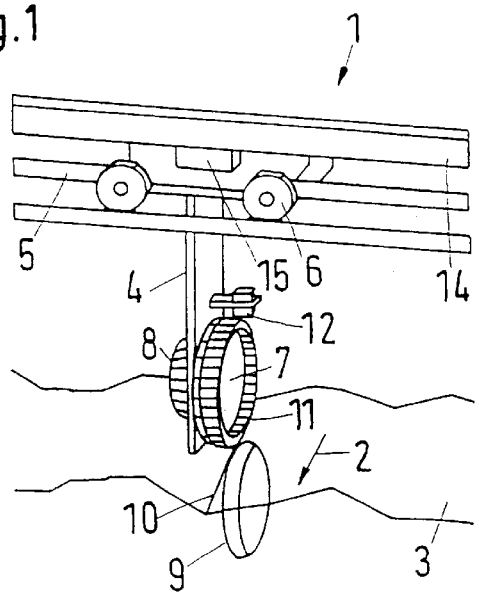
FIG. 1 is a perspective view of a schematic arrangement of a slitting device with a knife unit according to the present invention.

The particulars shown herein are by way of example and for purposes of illustrative discussion of the embodiments of the present invention only and are presented in the cause of providing a useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is described below using a paper web as an example of a material web. However, it is also applicable to all other material webs that must be cut lengthwise into strips of predetermined width in the course of their manufacture. Examples include metal or plastic foils as well as cardboard webs. In some cases, slitting serves only to straighten a longitudinal edge running parallel to the run direction. The present invention also may be applied for this purpose.

The present invention relates to a process and device for slitting a material web where the position of the cutting edge on the carrier itself and the position of the carrier in the machine frame are measured. The absolute position of the cutting edge in the machine frame is established by combining these two position indications.

In the process and device for slitting a material web according to the present invention, a relative measurement of the cutting edge and a reference position with respect to points on the machine frame is eliminated. Instead, the position of the cutting edge on the carrier is measured directly and thus with a greater precision. Therefore, it is also possible to obtain information on the position of the cutting edge during operation without needing to move the carriers past sensors during an interruption in operation, and subsequently reposition them. The risk of an error that exists with each repositioning is, therefore, reduced by the method and device according to the present invention.

Preferably, the position of the cutting edge on the carrier is measured by measuring a distance between the cutting edge and a first reference point that is fixed with respect to the carrier. This method is preferred because the distance of the cutting edge from the reference point changes, for example, when the cutting edge is moved as a result of resharpening the bottom knife.

In this regard, it is particularly preferred to monitor whether the distance falls below a predetermined minimum dimension or rises above a predetermined maximum dimension, and to output an error message in these cases. The question of whether a minimum or maximum dimension is monitored is decided based on the side from which one measures the distance to the knife edge. If the measurement occurs from the "back side" of the knife, then a minimum dimension is monitored. If the knife becomes excessively ground down, it is not usable because it is undersized. In contrast, if one measures from the other side, then the distance to the cutting edge increases with increased sharpening, so that after a certain number of sharpening processes, the knife is likewise no longer usable. Naturally, the same also applies in operation when wear phenomena occur. This can be detected immediately by the monitoring device.

A particular advantage of the invention is that both positions are continually measured. Therefore, both positions may be read during every program cycle of a microprocessor with which a control unit operates. There may certainly be short time intervals between individual readings, as is customary for microprocessor-controlled machines. However, these time intervals are normally in ranges below 1 second, and therefore, they have no practical significance. By continued monitoring, deviations of the cutting edge from the desired position may be quickly detected and, if necessary, compensated for.

In the method and device for slitting a material web according to the present invention the measurement device may have two measurement transducers. One of the transducers is a first measurement transducer arranged on the carrier, and measures the distance from the cutting edge to a first reference point that is fixed with respect to the carrier. The second measurement transducer measures the distance of a second reference point fixed with respect to the carrier from a zero point in the machine frame that is fixed with respect to the machine frame.

The use of a measurement transducer fixed with respect to the carrier makes it possible to directly measure the position of the cutting edge on the carrier, so that the risk of a measurement error remains relatively small. Therefore, the measurement precision may be increased. The position of the carrier in the machine frame can be measured by measuring the distance between a reference point fixed with respect to the carrier and the zero point in the machine frame. High measurement precision may be achieved here also. If the two measurement values are combined, the result is an exceptionally precise determination of position. Since this determination of position may take place in the operating position and, above all, during operation, any errors that arise may be compensated for very rapidly.

Preferably, in the method and device for slitting a material web according to the present invention, the second measurement transducer has a stationary active part and a passive movable part. Therefore, the second measurement transducer does not require any flexible connections between the carrier and an evaluation device. This simplifies operation and further reduces the risk of measurement errors.

Also, preferably, in the method and device for slitting a material web according to the present invention, the active part may be implemented as a linear measurement scale. This type of linear measurement scale works together with a location marker, i.e., the second reference point, on the carrier. The linear measurement scale may operate optically, acoustically. magnetically, electromagnetically, or capacitively. The linear measurement scale allows position measurement with a high degree of precision.

Further, preferably, the two reference points coincide, or exist together. This simplifies evaluation. An offset is no longer required in calculating the absolute position of the cutting edge.

In the method and device for slitting a material web according to the present invention, a comparator that is combined with the first measurement transducer and that outputs an error message if the distance drops below or rises above a predetermined value, is even more advantageous. As was described previously, error monitoring may be performed to determine whether the knife is undersized and thus must be replaced.

FIG. 1 shows a schematic diagram of a slitting device 1 for slitting a material web 3, e.g. a paper web, traveling in the run direction 2 according to present invention. Slitting device 1 has a carrier 4 that may also be referred to as "carriage". Carrier 4 is movable transversely to the run direction 2 on rails 5. Carrier 4 may be supported on rollers 6 for this purpose. Devices to fasten carrier 4 after it is moved, for example, a clamping device, are present but are not shown in the interest of clarity.

Carrier 4 supports a circular knife 7 that is driven by a motor 8. Circular knife 7 is located on one side of the material web 3, the top side in this case. On the other side of the material web. i.e., the bottom side, a mating knife 9 may be arranged, which may be placed against the circular knife 7. Mating knife 9 rests against an end face of circular knife 7 under spring force (not shown) with a relatively small overlap. Circular knife 7 and a mating knife 9 thus may act in the manner of a pair of scissors, and create a cutting line 10 whose position is defined by the position of the cutting edge 11 of circular knife 7.

Mating knife 9 does not hang freely in mid-air. It is attached to a carrier similar to carrier 4, which is not shown in the interest of clarity. The carrier for mating knife 9 may be positioned with a reduced precision because mating knife 9 may be placed against circular knife 7 by spring force.

Since the position of slitting line 10 must be maintained with a relatively high precision of approximately ±0.25 mm, it may be possible to position circular knife 7, or more specifically, its cutting edge 11, with exactly the same precision. A measurement device may be provided in order to monitor the positioning. The measurement device has a first measurement transducer 12 which measures the position of cutting edge 11 with respect to a reference point 13 on the carrier (represented as a line in FIG. 2).

Moreover, the measurement device may have a second measurement transducer. The second measurement transducer may include a linear measurement scale 14 mounted on the fixed machine frame (of which only the rails 5 are shown) and a location marker 15 rigidly attached to the carrier. In the embodiment of a method and device of slitting a material web according to the present invention shown here, the linear measurement scale 14 is the active part of the second measurement transducer, and the location marker 15 is the passive part. In the present embodiment, the right edge of location marker 15 is the "measurement point". Linear measurement scale 14 and location marker 15 may also be referred to as a position transducer. Similarly, measurement transducer 12 and cutting edge 11 may also be referred to as a position transducer. Both position transducers operate in a non-contacting manner, for example, by optical, acoustical, magnetic, electromagnetic, or capacitive methods.

The method of operation of the position measurement will now be described in greater detail by referring to FIG. 2. Identical parts are labeled with the same reference symbols. Material web 3 and the carrier for mating knife 9 are not shown in FIG. 2 for reasons of clarity. Two knife units A, B are shown.

In knife unit A, the first measurement transducer 12 measures a distance II between cutting edge 11 and reference point 13 (likewise the right edge of location marker 15). The second measurement transducer 14, 15 measures a distance I between a zero point 0 and the same reference point 13. Addition of the two distances then provides the distance from cutting edge 11 to the zero point 0, and thus the exact position of the cutting edge in the machine frame.

Figure 2:
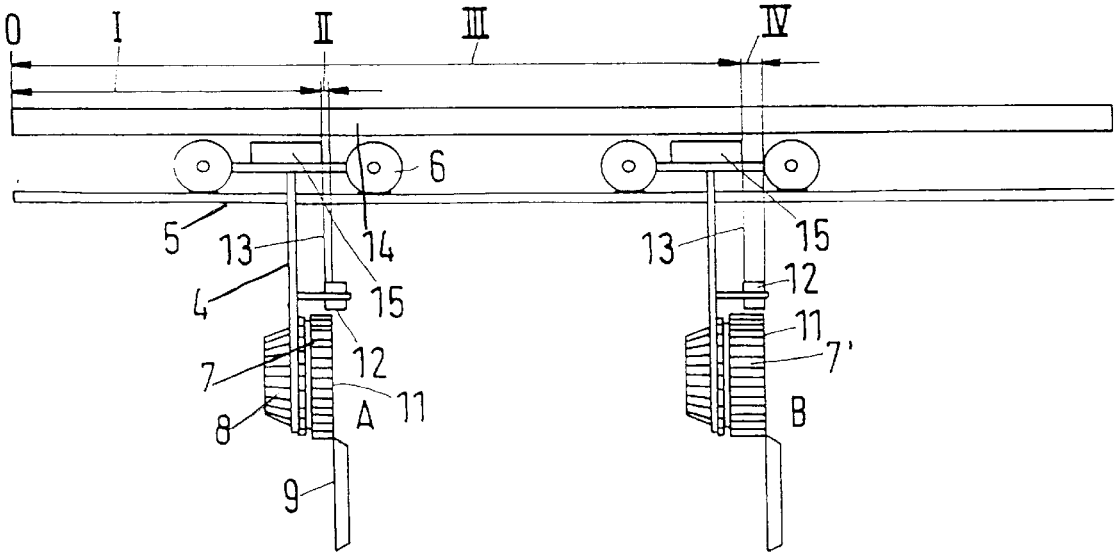
FIG. 2 is a side view of a slitting device with two knife units according to the present invention.

In order to illustrate a distinction, another identically constructed knife unit B with a less-severely worn circular knife 7' is shown in FIG. 2 on the right. The measurement transducer 12 may now measure a distance IV between cutting edge 11 and reference point 13. The second measurement transducer 14, 15 measures a distance III between the zero point 0 and reference point 13. The absolute distance of the cutting edge 11 of the circular knife 7' from the zero point 0 can be determined from these measurements.

In both cases, the presupposition is made that reference point 13 is the same for the first measurement transducer 12 and the second measurement transducer 14, 15. However, this is not crucial. Two different reference points may also be used. The distance between the two reference points must then be included in the calculation.

The individual distances I through IV are supplied to an evaluation unit that is not shown. The evaluation unit may also have a comparator that detects whether the distances II, IV fall under a predetermined minimum value. If the distance II or IV is less than or equal to this minimum value, the comparator outputs a warning. The immediate detection and indication of a circular knife 7 or 7' that is undersize is thus ensured.

When repositioning of the circular knives 7, 7' is necessary, the absolute position of cutting edge 11 on every carrier 4 is known to the evaluation unit mentioned above. The evaluation unit then need only ensure that carrier 4 with its reference point 13 takes up the appropriate position with respect to the linear measurement scale 14. To this end. the evaluation unit may move carrier 4. The evaluation unit may move carrier 4 either by a drive mechanism internal to the carriers, or by a drive mechanism external to the carriers, in a known manner.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described herein with reference to particular means, materials, and embodiments, the present invention is not intended to be limited to the particulars disclosed herein, rather, the present invention extends to all functionally equivalent structures, methods and uses, such as are within the scope of the appended claims.

What is claimed is:

1. A device for slitting a material web traveling in the run direction comprising:

a carrier, the carrier being in a machine frame, the carrier being movable transversely to the run direction;

at least one knife unit, the at least one knife unit having a cutting edge, the at least one knife unit attached to the carrier;

a first measurement transducer, the first measurement transducer being arranged on the carrier and measuring the distance of the cutting edge to a first reference point that is fixed with respect to the carrier; and a second measurement transducer, the second measurement transducer measuring the distance to a second reference point that is fixed with respect to the carrier from a zero point, the zero point being fixed in a machine frame, wherein an absolute position of the cutting edge in the machine frame is established by combining the measured distance of the cutting edge to the first reference point and the measured distance of the second reference point to the zero point in the machine frame.

2. The device according to claim 1, the carrier being supported on rollers that are movable along rails.

3. The device according to claim 1, the at least one knife unit comprising a circular knife driven by a motor.

4. The device according to claim 3, comprising a mating knife, the mating knife located on a bottom side of the material web, the mating knife being under a spring force and resting against an end face of the circular knife, the circular knife and the mating knife operating in a scissor-like manner to create a cutting line in the material web defined by the position of the cutting edge.

5. The device according to claim 1, at least one of the first measurement transducer and the second measurement transducer operating in a non-contacting manner.

6. The device according to claim 5, the non-contacting manner being optically.

7. The device according to claim 5, the non-contacting manner being acoustically.

8. The device according to claim 5, the non-contacting manner being magnetically.

9. The device according to claim 5, the non-contacting manner being electromagnetically.

10. The device according to claim 5, the non-contacting manner being capacitively.

11. The device according to claim 1, wherein the first reference point and the second reference point coincide.

12. The device according to claim 1, wherein a comparator is connected to the first measurement transducer, the comparator outputting an error message if the distance of the cutting edge to the first reference point exceeds a predetermined value.

13. The device according to claim 1, wherein a comparator is connected to the first measurement transducer, the comparator outputting an error message if the distance of the cutting edge to the first reference point drops below a predetermined value.

14. A device for slitting a material web traveling in the run direction comprising:

at least one knife unit, the at least one knife unit having a cutting edge, the at least one knife unit being on a carrier movable transversely to the run direction in a machine frame; and a measurement device to measure the position of the cutting edge, the measurement device comprising a first measurement transducer and a second measurement transducer, the first measurement transducer being arranged on the carrier and measuring the distance of the cutting edge to a first reference point that is fixed with respect to the carrier, the second measurement transducer measuring the distance to a second reference point that is fixed with respect to the carrier from a zero point, the zero point being fixed in the machine frame.

15. A device for slitting a material web traveling in the run direction comprising:

at least one knife unit, the at least one knife unit having a cutting edge, the at least one knife unit being on a carrier movable transversely to the run direction in a machine frame; and a measurement device to measure the position of the cutting edge, the measurement device comprising a first measurement transducer and a second measurement transducer, the first measurement transducer being arranged on the carrier and measuring the distance of the cutting edge to a first reference point that is fixed with respect to the carrier, the second measurement transducer measuring the distance to a second reference point that is fixed with respect to the carrier from a zero point, the zero point being fixed in a machine frame, the second measurement transducer comprising a stationary active part and a movable passive part.

16. The device according to claim 15, the active part being a linear measurement scale.

17. The device according to claim 14, wherein the first reference point and the second reference point coincide.

18. The device according to claim 14, wherein a comparator is connected to the first measurement transducer, the comparator outputting an error message if the distance of the cutting edge to the first reference point exceeds a predetermined value.

19. The device according to claim 14, wherein a comparator is connected to the first measurement transducer, the comparator outputting an error message if the distance of the cutting edge to the first reference point drops below a predetermined value.

* * * * *